US010542344B2

(12) United States Patent
Yang et al.

(10) Patent No.: US 10,542,344 B2
(45) Date of Patent: Jan. 21, 2020

(54) LOUDSPEAKER MODULE AND MANUFACTURING METHOD THEREOF

(71) Applicant: GOERTEK INC., Weifang (CN)

(72) Inventors: Xinfeng Yang, Weifang (CN); Tongyan Xu, Weifang (CN); Pengcheng Ji, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/850,297

(22) Filed: Dec. 21, 2017

(65) Prior Publication Data

US 2018/0115819 A1 Apr. 26, 2018

Related U.S. Application Data

(63) Continuation-in-part of application No. 15/327,649, filed as application No. PCT/CN2015/082944 on Jun. 30, 2015.

(30) Foreign Application Priority Data

Sep. 1, 2014 (CN) ..... 2014 1 0440182

(51) Int. Cl.
*H04R 1/28* (2006.01)
*H04R 1/02* (2006.01)
(Continued)

(52) U.S. Cl.
CPC ..... *H04R 1/288* (2013.01); *H04R 1/025* (2013.01); *H04R 1/2811* (2013.01); *H04R 9/025* (2013.01); *H04R 9/06* (2013.01); *H04R 31/00* (2013.01)

(58) Field of Classification Search
CPC ..... H04R 1/025; H04R 1/2811; H04R 1/288; H04R 31/00; H04R 9/025; H04R 9/06; H04R 2201/029
See application file for complete search history.

(56) References Cited

U.S. PATENT DOCUMENTS 2,973,295 A * 2/1961 Rodgers, Jr. ..... B65D 65/403 156/79
3,720,285 A * 3/1973 Russell ..... H04R 1/288 181/151
(Continued)

FOREIGN PATENT DOCUMENTS

CN 1431850 A 7/2003
CN 201967080 U 9/2011
(Continued)

OTHER PUBLICATIONS

International Search Report and Written Opinion dated Sep. 2, 2015 for PCT Application No. PCT/CN2015/082944.
(Continued)

*Primary Examiner* — Matthew A Eason
*Assistant Examiner* — Taunya McCarty
(74) *Attorney, Agent, or Firm* — Moser Taboada

(57) ABSTRACT

The present disclosure discloses a loudspeaker module and a manufacturing method thereof. The loudspeaker module comprises an outer casing; the outer casing accommodates a speaker unit; the speaker unit partitions an inner cavity of the whole module into two cavities: a front acoustic cavity and a rear acoustic cavity; the rear acoustic cavity is internally provided with a sound-absorbing material; the rear acoustic cavity is further provided with an isolating structure used for isolating the sound-absorbing material from the speaker unit; the isolating structure partitions the entire rear acoustic cavity into a filling area and a non-filling area; the sound-absorbing material is located in the filling area; the sound-absorbing material is a foaming material; the sound-absorbing material is formed by the foaming of the foaming material and then fills the filling area.

10 Claims, 3 Drawing Sheets

(51) Int. Cl.

| | |
|---|---|
| ***H04R 9/02*** | (2006.01) |
| ***H04R 31/00*** | (2006.01) |
| ***H04R 9/06*** | (2006.01) |

(56) References Cited

U.S. PATENT DOCUMENTS

| | | | | |
|---|---|---|---|---|
| 4,439,644 | A * | 3/1984 | Bruney, III | G10K 11/002 181/151 |
| 4,657,108 | A * | 4/1987 | Ward | H04R 1/2803 181/149 |
| 4,742,887 | A * | 5/1988 | Yamagishi | H04R 1/2857 181/129 |
| 4,881,617 | A | 11/1989 | Faraone | |
| 6,611,606 | B2 * | 8/2003 | Guenther | H04R 9/02 381/412 |
| 2007/0064958 | A1 * | 3/2007 | Nakamura | H04R 1/345 381/71.1 |
| 2013/0094685 | A1 * | 4/2013 | Seo | H04R 1/021 381/332 |

FOREIGN PATENT DOCUMENTS

| | | | |
|---|---|---|---|
| CN | 202663529 | U | 1/2013 |
| CN | 203193875 | U | 9/2013 |
| CN | 203708465 | U | 7/2014 |
| CN | 203788447 | U | 8/2014 |
| CN | 104202703 | A | 12/2014 |

OTHER PUBLICATIONS

Chinese Office Action for Application No. 201410440182.4.

Korean Office Action for Application No. 10-2017-7001310 dated Jan. 10, 2018.

* cited by examiner

LOUDSPEAKER MODULE AND MANUFACTURING METHOD THEREOF

CROSS-REFERENCE TO RELATED APPLICATIONS

This application is a Continuation-in-Part application of Ser. No. 15/327,649, filed Jan. 19, 2017 the entire contents of which are incorporated herein by reference. application Ser. No. 15/327,649 is a National Stage Entry of PCT/CN2015/082944, filed Jun. 30, 2015, based upon an original priority Chinese Patent Application No. 201410440182.4, filed Sep. 1, 2014.

TECHNICAL FIELD

The present disclosure relates to the technical field of electroacoustic products, and particularly to a loudspeaker module and a manufacturing method thereof.

BACKGROUND

A loudspeaker module is an important acoustic component in a portable electronic device and used to perform conversion between an electrical signal and a sound signal, and serves as an energy conversion component. The current loudspeaker module usually comprises a casing in which a speaker unit is received, and the speaker unit divides an inner cavity of the whole module into two cavities, namely, a front acoustic cavity and a rear acoustic cavity. To reduce FO (low frequency) of the module and expand the bandwidth, a technician usually additionally arrange a sound-absorbing cotton in the rear acoustic cavity, the sound-absorbing cotton may effectively reduce the FO of the module, makes an intermediate frequency curve smoother and is an important component in the loudspeaker module. A degree of the function of the sound-absorbing cotton in the rear acoustic cavity is directly related to a fill amount of the sound-absorbing cotton in the rear acoustic cavity. Fill of as much as possible sound-absorbing cotton in the rear acoustic cavity is of a positive significance to improvement of the performance of the loudspeaker module.

The rear acoustic cavity of the loudspeaker module in the current stage is usually irregular. The thickness of the current sound-absorbing cotton is fixed. To fill the sound-absorbing cotton with the fixed thickness into the rear acoustic cavity which rises and falls, only a manner of sticking and putting together a plurality of sound-absorbing cottons can be used to ensure adaptation of the sound-absorbing cottons to the rear acoustic cavity. However, this manner makes it very difficult to control closeness between the sound-absorbing cottons and the casing as well as a compression ratio of the sound-absorbing cottons, and causes undesirable consistency of the module; furthermore, according to the manner, the sound-absorbing cottons can only be stuck together manually, worker's labor intensity is large, operation difficulty is high, labor cost is caused high, and therefore, product costs of the product are caused high and the production efficiency is made low.

SUMMARY

The technical problem to be solved by the present disclosure is to provide a loudspeaker module and a manufacturing method thereof, the sound-absorbing material of which is completely close to the rear acoustic cavity so that products exhibit good consistency, low costs and high production efficiency.

To solve the above technical problem, the present disclosure employs the following technical solutions:

A loudspeaker module comprises an outer casing, the outer casing accommodating a speaker unit, the speaker unit partitioning an inner cavity of the whole module into two cavities, namely, a front acoustic cavity and a rear acoustic cavity, the rear acoustic cavity being internally provided with a sound-absorbing material, wherein the rear acoustic cavity is further provided with an isolating structure used for isolating the sound-absorbing material from the speaker unit; the isolating structure partitions the entire rear acoustic cavity into a filling area and a non-filling area, the sound-absorbing material is located in the filling area; the sound-absorbing material is a foaming material, and wherein the sound-absorbing material is formed by the foaming of the foaming material, the sound-absorbing material has a structure identical with the structure of the filling area and fills the entire filling area.

Preferably, the isolating structure is provided with a pore allowing air stream to circulate between the filling area and non-filling area.

Preferably, the isolating structure is a net-shaped thin sheet structure, wherein the foaming material is PU, DWT or melamine.

Preferably, the sound-absorbing material is formed by foaming the foaming material by a process such as heating, ultrasonic or infrared lamp irradiation.

Preferably, the sound-absorbing material has a structure that one side of its cross section is a stepped surface and the other side of its cross section is an arcuate surface, or a structure that two sides of its cross section are both stepped surfaces, or a structure that one side of its cross section is a stepped surface and the other side of its cross section is a planar surface.

Preferably, the isolating structure is made of a plastic material or metallic material, and the isolating structure and the outer casing is engaged by injection molding or adhesion.

As an implementation mode, the outer casing comprises a first casing, a second casing and a third casing which are engaged together in turn, the speaker unit, the second casing and third casing jointly enclose the rear acoustic cavity, and the isolating structure is vertically disposed between the second casing and third casing.

Wherein a cross section of the filling area is an approximately bulge-shaped structure which is higher in the middle and lower on both ends, and the sound-absorbing material has a structure identical with the structure of the filling area, fills the entire filling area.

Preferably, the magnetic circuit system comprises a basin-like stand fixed on the second casing, an inner magnet and an inner washer are fixed in turn at a middle position inside the basin-like stand, and an outer magnet and an outer washer are fixed in turn at an edge portion inside the basin-like stand, a positioning recess formed by incomplete filling is formed on one side of the outer washer adjacent to the second casing, a positioning boss is provided at a position on an inner wall of the second casing corresponding to the positioning recess, and the positioning boss is engaged at the positioning recess.

As another implementation mode, the outer casing comprises a first casing and a second casing which are engaged together, the speaker unit, the first casing and second casing jointly enclose the rear acoustic cavity, and the isolating structure is vertically disposed between the first casing and second casing.

Wherein both an upper end and a lower end of the filling area are provided with a groove extending towards above and below the filling area respectively, each of the grooves is a triangular groove with a large opening and a pointed bottom, the sound-absorbing material has a structure completely consistent with the structure of the filling area, and fills each of said grooves.

As an implementation mode, the foaming material is a solid material, it is first placed in the filling area, and then the rear acoustic cavity is sealed.

A manufacturing method of a loudspeaker module comprising:

forming an outer casing, the outer casing comprises at least two casings, the casings are engaged together and jointly encloses an inner cavity, and the inner cavity is provided with an isolating structure;

accommodating a speaker unit in the inner cavity, the speaker unit partitions the inner cavity into two cavities, namely, a front acoustic cavity and a rear acoustic cavity;

partitioning, by the isolating structure, the entire rear acoustic cavity into a filling area and a non-filling area, the isolating structure is provided with a pore allowing air stream to circulate between the filling area and the non-filling area;

putting a foaming material in the filling area, and sealing the rear acoustic cavity; and forming a sound-absorbing material by the foaming of the foaming material, the sound-absorbing material has a structure identical with the structure of the filling area and fills the entire filling area.

As another implementation mode, the foaming material is a liquid material, the rear acoustic cavity is sealed first, and then the liquid foaming material is injected through a leakage hole of the rear acoustic cavity into the filling area.

The present disclosure achieves the following advantageous effects by employing the above technical solutions:

In the present disclosure, in the rear acoustic cavity of the loudspeaker module is provided a sound-absorbing material as well as an isolating structure, the isolating structure partitions the rear acoustic cavity into a filling area and a non-filling area, the sound-absorbing material is located in the filling area, and the sound-absorbing material is formed by the foaming of the foaming material and fills the entire filling area. When the module is assembled, the foaming material is placed in the rear acoustic cavity of the module, the foaming material becomes foam by heating or ultrasonic process, and expands and fills the filling area of the entire rear acoustic cavity; the isolating structure functions to isolate, and may prevent the foaming material from expanding to the speaker unit upon foaming to affect the performance of the speaker unit. Since the sound-absorbing material formed after the foaming material foams may completely get close to the casings which enclose the rear acoustic cavity, the space of the rear acoustic cavity is sufficiently used, the low-frequency FO of the module is substantially reduced, so that the frequency band of the module is made wider, an intermediate-frequency curve is made smoother, and acoustic performance of the module is made better. Meanwhile, this sound-absorbing material fabricated by a foaming technology needn't be accomplished manually, effectively reduces the number of workers, saves labor, reduces production costs and improves the production efficiency. Furthermore, the sound-absorbing material is closer to the rear acoustic cavity of the module, and the products exhibits better consistency.

To conclude, the loudspeaker module of the present disclosure solves technical problems of the loudspeaker module products in the prior art such as undesirable consistency and high production costs. The loudspeaker module according to the present disclosure exhibits a good acoustic performance, a high production efficiency, low production costs and high product consistency.

The above depictions are only generalization of technical solutions of the present disclosure, which may be implemented according to content of the description to make technical means of the present disclosure clearer. Specific embodiments of the present disclosure are presented below to make the above and other objects, features and advantages of the present disclosure more apparent.

BRIEF DESCRIPTION OF THE DRAWINGS

Various other advantages and merits will become apparent to those having ordinary skill in the art by reading through the following detailed description of preferred embodiments. The drawings are only intended to illustrate preferred embodiments and not construed as limiting the present disclosure. In the drawings.

Figure 1:
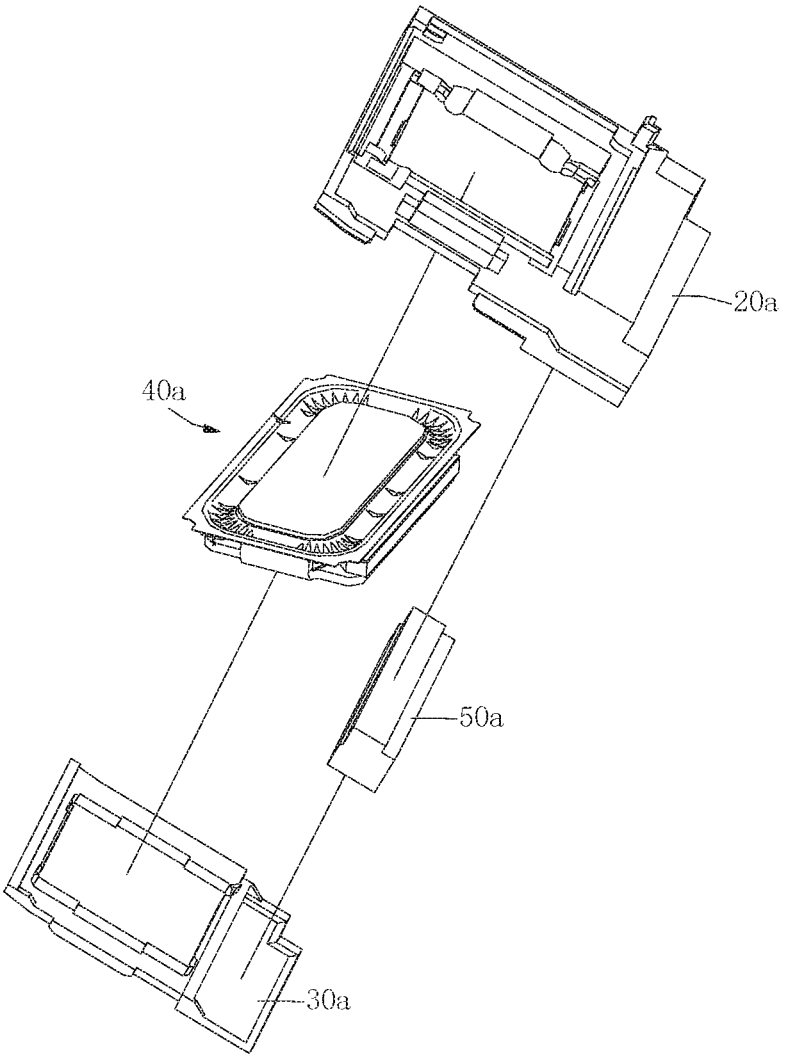
FIG. 1 is an exploded perspective structural schematic view of Embodiment 1 of a loudspeaker module according to the present disclosure, not including a first casing.

In the drawings, the reference number 10*a* denotes a first casing, 10*b* first casing, 12 sound aperture, 20*a* second casing, 20*b* second casing, 22 ultrasonic line, 30*a* third casing, 40*a* speaker unit, 40*b* speaker unit, 41 dome, 42 diaphragm, 43 voice coil, 44 basin-like stand, 45 inner magnet, 46 outer magnet, 47 inner washer, 48 outer washer, 49 gasket, 50*a* sound-absorbing material, 50*b* sound-absorbing material, 60*a* isolating structure, 60*b* isolating structure, 61*a* positioning recess and 62*a* positioning boss.

DETAILED DESCRIPTION

The present disclosure will be further illustrated with reference to figures and embodiments.

The orientation "up" involved in the present description refers to a direction of a vibration system of a speaker unit, and the orientation "down" refers to a direction of a magnetic circuit system of the speaker unit. "Inside" involved in the present description refers to a side located in the module inner cavity or speaker unit inner cavity, and "outside" refers to a side located outside the module inner cavity or speaker unit inner cavity.

Embodiment 1

Figure 2:
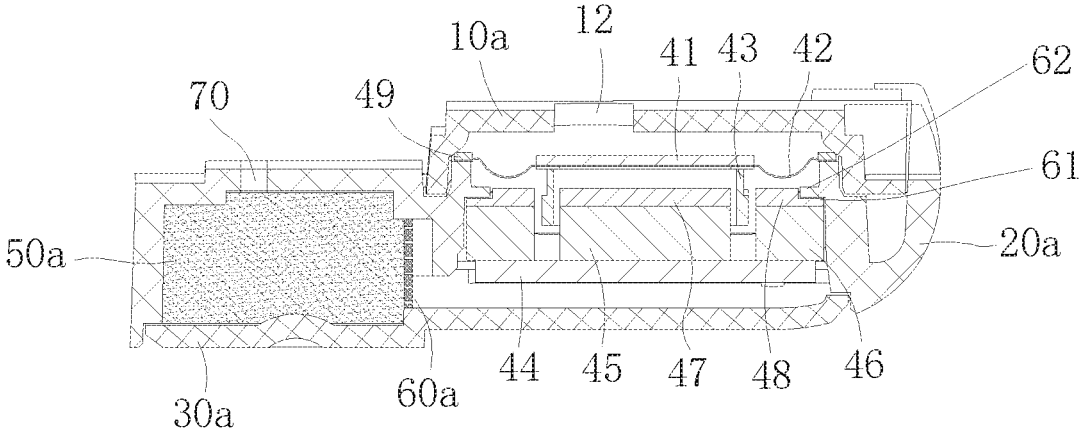
FIG. 2 is a sectional structural schematic view of Embodiment 1 of the loudspeaker module according to the present disclosure.

As jointly shown in FIG. 1 and FIG. 2, a loudspeaker module comprises an outer casing comprised of a first casing 10*a*, a second casing 20*a* and a third casing 30*a* which are engaged together in turn, and a speaker unit 40*a* is received in a space enclosed by the first casing 10*a*, the second housing 20*a* and third casing 30*a*. The speaker unit 40*a* partitions the entire module inner cavity into two cavities, namely, a front acoustic cavity and a rear acoustic cavity, the speaker unit 40*a* and the first casing 10*a* jointly enclose the front acoustic cavity, and the first casing 10*a* is provided with a sound aperture 12 through which sound wave spreads out; the speaker unit 40*a*, the second casing 20*a* and third casing 30*a* jointly enclose the rear acoustic cavity. In the rear acoustic cavity is provided a sound-absorbing material 50*a* and further provided with an isolating structure 60*a* isolating the sound-absorbing material 50*a* from the speaker unit 40*a*. The isolating structure 60*a* is vertically disposed between the second casing 20*a* and third casing 30*a*, and it partitions the entire rear acoustic cavity into a filling area and a non-filling area. The isolating structure 60*a* is provided with a pore allowing sound wave to circulate between the filling area and non-filling area. A preferred isolating structure 60*a* of the present embodiment is a net-shaped thin sheet structure, the sound-absorbing material 50*a* is located in the filling area, and a lower half of the speaker unit 40*a* is located in the non-filling area. The isolating structure 60*a* is made of a plastic material or metallic material, and it may be engaged with the casing by injection molding or adhesion.

As jointly shown by FIG. 1 and FIG. 2, the sound-absorbing material 50*a* is a foaming material. The sound-absorbing material 50*a* is formed by the foaming of the foaming material and fills the entire filling area. The foaming material comprises PU (polyurethane), DWT (a foaming sponge) or melamine. The above foaming material is placed in the filling area of the rear acoustic cavity when the module is assembled, the foaming material becomes foam by a process such as heating, ultrasonic or infrared lamp irradiation, and fills the filling area of the entire rear acoustic cavity in a seamless filling and totally-close manner, to thereby form the sound-absorbing material 50*a* completely close to the rear acoustic cavity. The foaming material is not limited to the above three kinds. The above three kinds of foaming material are preferred material of the present disclosure. In practical application, it is feasible to select a solid foaming material or a liquid foaming material. If the foaming material is a solid material, it is placed in the filling area of the rear acoustic cavity before the rear acoustic cavity is sealed, then the rear acoustic cavity is sealed, and then the foaming material placed in the filling area of the rear acoustic cavity becomes foam by a foaming process, and the foaming material expands and fills the filling area of the entire rear acoustic cavity to form the sound-absorbing material completely close to the rear acoustic cavity. If the foaming material is a liquid material, the rear acoustic cavity is sealed first, then the liquid foaming material is injected through a position such as a leakage hole of the rear acoustic cavity into the filling area of the rear acoustic cavity, the foaming material already injected into the filling area of the rear acoustic cavity becomes foam by a foaming process, and the foaming material expands and fills the filling area of the entire rear acoustic cavity to form the sound-absorbing material completely close to the rear acoustic cavity. The sound-absorbing material formed by the foaming of the foaming material is simple and workable to fabricate, may completely get close to the casing of the rear acoustic cavity, and substantially improves acoustic performance of the module and consistency of the module.

As shown in FIG. 2, a section of the filling area is an approximately bulge shape whose upper end is a concave-convex structure and whose lower end is a planar structure, so the structure of the entire filling area is higher in the middle and lower on both sides. The sound-absorbing material 50*a* has a structure completely identical with the structure of the filling area, fills the entire filling area, complete gets close to the second casing 20*a*, third casing 30*a* and isolating structure 60*a* which enclose the filling area, makes full use of the space of the rear acoustic cavity, substantially reduces the low frequency FO of the module, increases a frequency bandwidth of the module, and makes the intermediate frequency curve of the module smoother.

As shown in FIG. 2, the speaker unit 40*a* comprises a vibration system and a magnetic circuit system. The vibration system comprises a diaphragm 42 whose edge portion is fixed on an end face of the second casing 20*a*, a gasket 49 is fixed on an upper portion of the edge portion of the diaphragm 42, and the gasket 49 is used to enhance firmness of the fixation of the diaphragm 42 and prevent the diaphragm 42 from disengaging from the second casing 20*a* upon vibration. A dome 41 is fixed at a middle position of a side of the diaphragm 42 adjacent to the first casting 10*a*, and a voice coil 43 is fixed on the other side of the diaphragm 42. The magnetic circuit system comprises a basin-like stand 44 fixed inside the second casing 20*a*, an inner magnet 45 and an inner washer 47 are fixed in turn at a middle position inside the basin-like stand 44, and an outer magnet 46 and an outer washer 48 are fixed in turn at an edge position inside the basin-like stand 44. The inner magnet 45 and inner washer 47 constitute an inner magnetic circuit of the speaker unit, the outer magnet 46 and outer washer 48 constitute an outer magnetic circuit of the speaker unit, a magnetic gap is provided between the inner magnetic circuit and outer magnetic circuit, and a lower end of the voice coil 43 is located in the magnetic gap. The voice coil 43 moves up and down in the magnetic gap according to a magnitude and direction of a sound wave electrical signal running through windings thereof, the diaphragm 42 vibrates along with up-down movement of the voice coil 43, urges air to generate a sound and thereby complete electro-acoustic energy conversion.

As shown in FIG. 2, a positioning recess formed by incomplete filling is formed at an upper portion of one side of the outer washer 48 adjacent to the second casing 20*a*, a positioning boss is provided at a position of an inner wall of the second casing 20*a* corresponding to the positioning recess, and the positioning boss is engaged at the positioning recess. Such structure increases a contact area of the outer washer 48 and second casing 20*a*, improves firmness of engagement between the outer washer 48 and second casing 20*a*, effectively prevents the outer magnetic circuit from approaching the inner magnetic circuit under action of the magnetic field, and boosts stability of the product.

As shown in FIG. 2, an end (namely, an end located in the magnetic gap) of the voice coil 43 away from the diaphragm 42 has more winding turns and a larger thickness, makes full use of the magnetic gap, improves the acting force of the magnetic field and increases sensitivity of the module.

Embodiment 2

Figure 3:
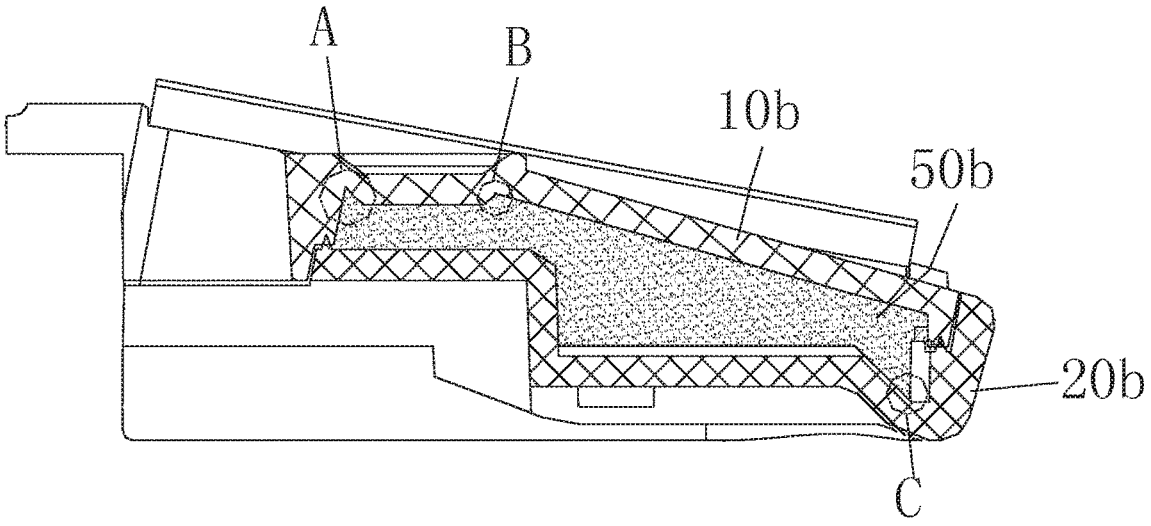
FIG. 3 is a sectional structural schematic view of Embodiment 2 of the loudspeaker module according to the present disclosure.
Figure 4:
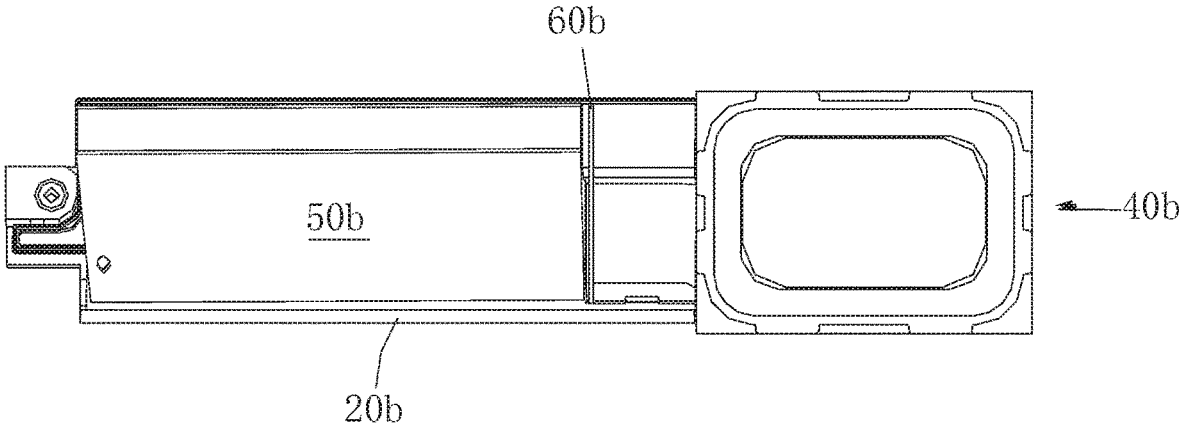
FIG. 4 is a structural schematic view of Embodiment 2 of a loudspeaker module according to the present disclosure, with the first casing not installed.

As jointly shown in FIG. 3 and FIG. 4, a loudspeaker module comprises an outer casing comprised of a first casing

10*b* and a second casing 20*b* which are engaged together, a speaker unit 40*b* is received in a space enclosed by the first casing 10*b* and the second housing 20*b*. The speaker unit 40*b* partitions the entire module inner cavity into two cavities, namely, a front acoustic cavity and a rear acoustic cavity, and the speaker unit 40*b*, the first casing 10*b* and second casing 20*b* jointly enclose the rear acoustic cavity of the module. In the rear acoustic cavity is provided with a sound-absorbing material 50*b* and further provided with an isolating structure 60*b* isolating the sound-absorbing material 50*b* from the speaker unit 40*b*. The isolating structure 60*b* is vertically disposed between the first casing 10*b* and second casing 20*b*. The isolating structure 60*b* partitions the entire rear acoustic cavity into a filling area and a non-filling area, the sound-absorbing material 50*b* is located in the filling area, and a lower half of the speaker unit 40*b* is located in the non-filling area.

As shown in FIG. 4, the isolating structure 60*b* in the present embodiment is identical with the isolating structure 60*a* (as shown in FIG. 2) of Embodiment 1 in both structure and material, and therefore is not detailed herein.

Figure 5:
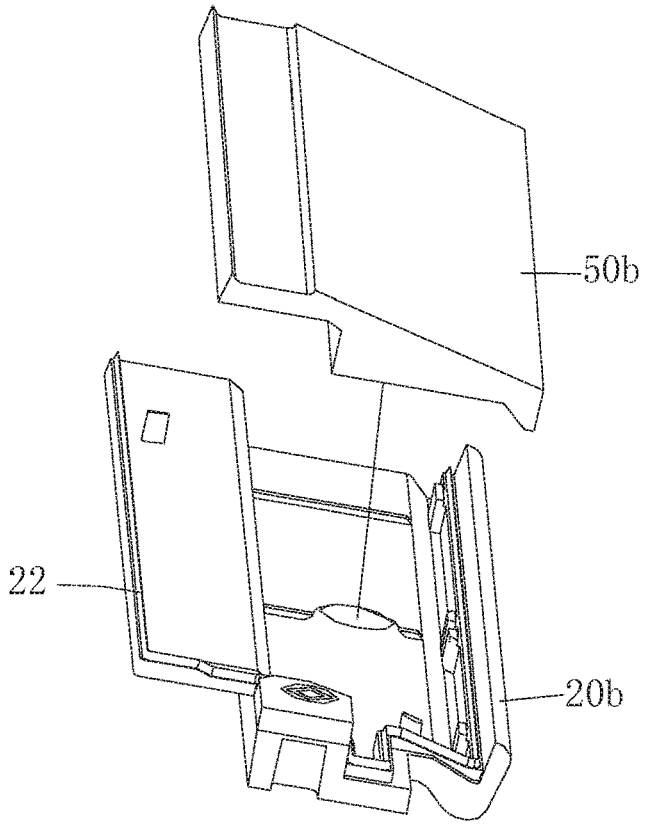
FIG. 5 is an exploded structural schematic view of a sound-absorbing material and a second casing of Embodiment 2 of a loudspeaker module according to the present disclosure.

As jointly shown in FIG. 3 and FIG. 5, the sound-absorbing material 50*b* in the present embodiment is identical with Embodiment 1 in both material and manufacturing process, and differs from the sound-absorbing material 50*a* (as shown in FIG. 1) only in the structure.

As jointly shown by FIG. 3 and FIG. 5, the filling area of the rear acoustic cavity in the present embodiment is an irregular structure, an upper end of the filling area is provided with two grooves extending longitudinally towards above the filling area, each of the two grooves is a triangular groove with a large opening and a pointed bottom, as shown by portion A and portion B in FIG. 3; a lower end of the filling area is a stepped structure, a groove extending longitudinally towards below the filling area is provided on an edge of one side of the stepped structure, and the groove is also a triangular groove with a large opening and a pointed bottom, as shown in portion C of FIG. 3. The sound-absorbing material 50*b* has the same structure as the filling area, and fills the entire filling area, including the bottom of each triangular groove.

As jointly shown by FIG. 3 and FIG. 5, an ultrasonic line 22 is disposed at a position of the second casing 20*b* engaged with the first casing 10*b*, and the first casing 10*b* is engaged with the second casing 20*b* in an ultrasonic sealed manner.

The present embodiment is different from Embodiment 1 only in the structure of the loudspeaker module, and identical with Embodiment 1 in terms of the technical problem to be solved, technical means employed to solve the technical problem, and the technical effects achieved by employing the technical means. Hence, the two embodiments meet unity requirement.

Embodiment 3

Based on the embodiments 1 and 2, a manufacturing method of a loudspeaker module is provided, the method comprising:

forming an outer casing, the outer casing comprises at least two casings, the casings are engaged together and jointly encloses an inner cavity, and the inner cavity is provided with an isolating structure;

accommodating a speaker unit in the inner cavity, the speaker unit partitions the inner cavity into two cavities, namely, a front acoustic cavity and a rear acoustic cavity;

partitioning, by the isolating structure, the entire rear acoustic cavity into a filling area and a non-filling area, the isolating structure is provided with a pore allowing air stream to circulate between the filling area and the non-filling area;

putting a foaming material in the filling area, and sealing the rear acoustic cavity; and forming a sound-absorbing material by the foaming of the foaming material, the sound-absorbing material has a structure identical with the structure of the filling area and fills the entire filling area.

Preferably, the foaming material is a solid material, it is first placed in the filling area, and then the rear acoustic cavity is sealed.

Preferably, the foaming material is a liquid material, the rear acoustic cavity is sealed first, and then the foaming material is injected through a leakage hole of the rear acoustic cavity into the filling area.

In the present description, exemplary illustration is presented for the technical solution that the sound-absorbing material of the present disclosure is formed by using a foaming material by a foaming process by taking the module described in the above two embodiments as an example. In practical application, this technical solution may be applied to any loudspeaker module in which the sound-absorbing material is disposed in the rear acoustic cavity, which may implemented by those skilled in the art without making any inventive efforts according to illustrations in the present description. Hence, no detailed depictions are given to specific embodiments in which the technical solution that the sound-absorbing material is fabricated by a foaming process using the foaming material is applied to loudspeaker modules with other structures. Furthermore, no matter whether the structure of the loudspeaker module and the speaker unit received therein is identical with the above two embodiments, the foaming material falls within the protection scope of the present disclosure so long as the sound-absorbing material disposed in the rear acoustic cavity is fabricated by a foaming process by using the foaming material.

Figure 6:
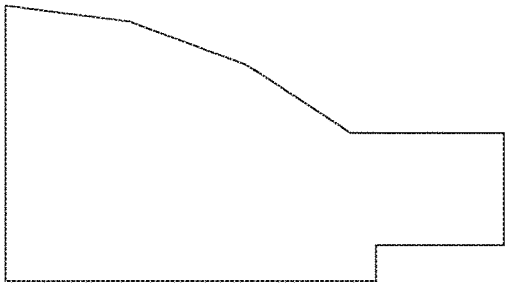
FIG. 6 is a sectional structural view of a sound-absorbing material processed by a foaming process.
Figure 7:
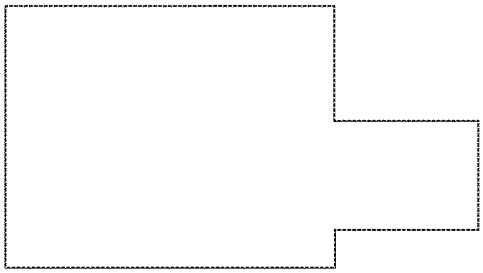
FIG. 7 is a sectional structural view of another sound-absorbing material processed by a foaming process.
Figure 8:
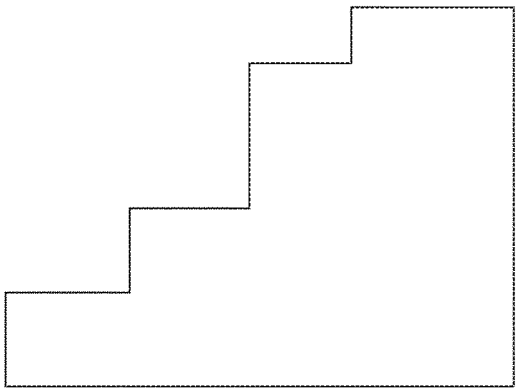
FIG. 8 is a sectional structural view of a further sound-absorbing material processed by a foaming process.

The structure of the sound-absorbing material fabricated with the foaming material is also not limited to the structures as described in the above two embodiments, and sound-absorbing materials of various structures completely close to the rear acoustic cavity of the module may be processed according to difference of the structure of the rear acoustic cavity of the module, for example, the sound-absorbing material with a structure that one side is a stepped surface and the other side is an arcuate surface as shown in FIG. 6, with a structure that both sides are stepped surfaces as shown in FIG. 7, or with a structure that one side is a stepped surface and the other side is planar surface as shown in FIG. 8.

Naming of the first casing, second casing and third casing involved in Embodiment 1 of the present disclosure is only intended to distinguish technical features, and does not represents an installation order, an operation order and positional relationship of the three casings.

Naming of the first casing and second casing involved in Embodiment 2 of the present disclosure is only intended to distinguish technical features, and does not represents an installation order, an operation order and positional relationship of the two casings.

The present disclosure is not limited to the above specific embodiments, and diverse variations made by those having ordinary skill in the art starting from the above concept without making any inventive efforts all fall within the protection scope of the present disclosure.

The invention claimed is:

1. A loudspeaker module, comprising an outer casing, the outer casing comprising a first casing and a second casing which are engaged together, the outer casing accommodating a speaker unit, the speaker unit partitioning an inner cavity of the whole module into two cavities, namely, a front acoustic cavity and a rear acoustic cavity, the speaker unit, the first casing and the second casing jointly enclosing the rear acoustic cavity, the rear acoustic cavity being internally provided with a sound-absorbing material, wherein the rear acoustic cavity is further provided with an isolating structure used for isolating the sound-absorbing material from the speaker unit, the isolating structure is vertically disposed between the first casing and the second casing, the isolating structure is a net-shaped thin sheet structure, the isolating structure and the outer casing are engaged by injection molding or adhesion;

the isolating structure partitions the entire rear acoustic cavity into a filling area and a non-filling area, the isolating structure is provided with pores allowing air stream to circulate between the filling area and non-filling area, an upper end of the filling area is provided with a groove extending above the filling area, and a lower end of the filling area is provided with a groove extending below the filling area, each of the grooves is a triangular groove with a large opening and a pointed bottom; and the sound-absorbing material is located in the filling area, the sound-absorbing material is a foaming material, the sound-absorbing material is formed by the foaming of the foaming material, and the sound-absorbing material has a structure identical with the structure of the filling area and fills the entire filling area.

2. The loudspeaker module according to claim 1, wherein the speaker unit comprising a vibration system and a magnetic circuit system, the magnetic circuit system comprises a basin-like stand fixed on the second casing, an inner magnet and an inner washer are fixed in turn at a middle position inside the basin-like stand, an outer magnet and an outer washer are fixed in turn at an edge portion inside the basin-like stand, a positioning recess is formed on one side of the outer washer adjacent to the second casing, a positioning boss is provided at a position on an inner wall of the second casing corresponding to the positioning recess, and the positioning boss is engaged at the positioning recess.

3. The loudspeaker module according to claim 1, wherein the sound-absorbing material has a structure in which one side of its cross section is a stepped surface and the other side of its cross section is an arcuate surface, or a structure in which two sides of its cross section are both stepped surfaces, or a structure in which one side of its cross section is a stepped surface and the other side of its cross section is a planar surface.

4. The loudspeaker module according to claim 1, wherein the isolating structure is made of a plastic material or metallic material.

5. A manufacturing method of a loudspeaker module, wherein the method comprising:

forming an outer casing, the outer casing comprises a first casing and a second casing which are engaged together, the casings are engaged together and jointly enclose an inner cavity;

accommodating a speaker unit in the inner cavity, the speaker unit partitions the inner cavity into two cavities, namely, a front acoustic cavity and a rear acoustic cavity, the speaker unit, the first casing and the second casing jointly encloses the rear acoustic cavity;

providing an isolating structure in the rear acoustic cavity, the isolating structure is vertically disposed between the first casing and the second casing, the isolating structure is a net-shaped thin sheet structure, the isolating structure and the outer casing are engaged by injection molding or adhesion;

partitioning, by the isolating structure, the entire rear acoustic cavity into a filling area and a non-filling area, the isolating structure is provided with pores allowing air stream to circulate between the filling area and the non-filling area, an upper end of the filling area is provided with a groove extending above the filling area, and a lower end of the filling area is provided with a groove extending below the filling area, each of the grooves is a triangular groove with a large opening and a pointed bottom;

putting a foaming material in the filling area, and sealing the rear acoustic cavity; and forming a sound-absorbing material by the foaming of the foaming material, the sound-absorbing material has a structure identical with the structure of the filling area and fills the entire filling area.

6. The manufacturing method according to claim 5, wherein the foaming material is a solid material, it is first placed in the filling area, and then the rear acoustic cavity is sealed.

7. The manufacturing method according to claim 5, wherein the foaming material is a liquid material, the rear acoustic cavity is sealed first, and then the foaming material is injected through a leakage hole of the rear acoustic cavity into the filling area.

8. The manufacturing method according to claim 5, wherein the speaker unit comprising a vibration system and a magnetic circuit system, the magnetic circuit system comprises a basin-like stand fixed on the second casing, an inner magnet and an inner washer are fixed in turn at a middle position inside the basin-like stand, an outer magnet and an outer washer are fixed in turn at an edge portion inside the basin-like stand, a positioning recess is formed on one side of the outer washer adjacent to the second casing, a positioning boss is provided at a position on an inner wall of the second casing corresponding to the positioning recess, and the positioning boss is engaged at the positioning recess.

9. The manufacturing method according to claim 5, wherein the sound-absorbing material has a structure in which one side of its cross section is a stepped surface and the other side of its cross section is an arcuate surface, or a structure in which two sides of its cross section are both stepped surfaces, or a structure in which one side of its cross section is a stepped surface and the other side of its cross section is a planar surface.

10. The manufacturing method according to claim 5, wherein the isolating structure is made of a plastic material or metallic material.

* * * * *